US007845953B2

(12) United States Patent
Brock et al.

(10) Patent No.: US 7,845,953 B2
(45) Date of Patent: Dec. 7, 2010

(54) INPUT/OUTPUT CONNECTOR AND HOUSING

(75) Inventors: John Brock, Cupertino, CA (US); Brett William Degner, Cupertino, CA (US); Dinesh Mathew, Cupertino, CA (US); Thomas W. Wilson, Jr., Cupertino, CA (US); Chris Ligtenberg, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/201,867

(22) Filed: Aug. 29, 2008

(65) Prior Publication Data

US 2009/0176391 A1 Jul. 9, 2009

Related U.S. Application Data

(60) Provisional application No. 61/019,530, filed on Jan. 7, 2008.

(51) Int. Cl.
*H01R 13/60* (2006.01)

(52) U.S. Cl. ..... 439/39; 439/136
(58) Field of Classification Search ..... 439/136–138, 439/39–40; 361/684
See application file for complete search history.

(56) References Cited

U.S. PATENT DOCUMENTS

| | | | | |
|---|---|---|---|---|
| 5,081,482 | A * | 1/1992 | Miki et al. | 396/211 |
| 5,317,105 | A | 5/1994 | Weber | |
| 5,342,991 | A | 8/1994 | Xu et al. | |
| 5,598,319 | A * | 1/1997 | Lee | 361/679.33 |
| 5,770,898 | A | 6/1998 | Hannigan et al. | |
| 5,815,379 | A * | 9/1998 | Mundt | 361/679.55 |
| 5,975,953 | A | 11/1999 | Peterson | |
| 6,125,031 | A * | 9/2000 | Della Fiora et al. | 361/679.58 |
| 6,130,822 | A * | 10/2000 | Della Fiora et al. | 361/724 |
| 6,525,929 | B2 * | 2/2003 | Carr | 361/679.02 |
| 6,713,672 | B1 | 3/2004 | Stickney | |
| 6,800,805 | B2 | 10/2004 | Deguchi | |
| 7,189,084 | B2 * | 3/2007 | Iikura | 439/135 |
| 7,347,712 | B2 * | 3/2008 | O'Connell et al. | 439/373 |
| 7,470,866 | B2 | 12/2008 | Dietrich et al. | |
| 7,473,139 | B2 | 1/2009 | Barringer et al. | |
| 2004/0238195 | A1 | 12/2004 | Thompson | |
| 2006/0042820 | A1 | 3/2006 | Lin et al. | |
| 2009/0173533 | A1 | 7/2009 | Brock et al. | |
| 2009/0173534 | A1 | 7/2009 | Keiper et al. | |
| 2010/0044067 | A1 | 2/2010 | Wong et al. | |

* cited by examiner

*Primary Examiner*—Truc T Nguyen
(74) *Attorney, Agent, or Firm*—Dorsey & Whitney LLP

(57) ABSTRACT

A movable I/O port and housing therefore. The I/O port housing may be hinged to pivot between an open and closed position. The pivot point may be a low- or zero-friction pivot. The I/O port housing may include an opening mechanism to facilitate pivoting the port between the open and closed positions, and/or vice versa. For example, the opening mechanism may take the form of paired magnets of like polarities.

18 Claims, 5 Drawing Sheets

INPUT/OUTPUT CONNECTOR AND HOUSING

CROSS-REFERENCE TO RELATED APPLICATIONS

This application claims priority under 37 C.F.R. §119(e) to U.S. Provisional Patent Application No. 61/019,530, filed on Jan. 7, 2008 and entitled "Input/Output Connector and Housing," which is incorporated by reference herein as if fully set forth in its entirety. This application is related to 1) U.S. Provisional Patent Application No. 61/019,538, filed Jan. 7, 2008 and entitled "Flexible Data Cable;" 2) U.S. Provisional Patent Application No. 61/019,540, filed Jan. 7, 2008 and entitled "I/O Connectors with Extendable Faraday Cage;" 3) U.S. Nonprovisional patent application Ser. No. 12/201,975, filed Aug. 29, 2008, and entitled "Flexible Data Cable," and 4) U.S. Nonprovisional patent application Ser. No. 12/202,038, filed Aug. 29, 2008, and entitled "I/O Connectors with Extendable Faraday Cage"; all of which are incorporated by reference herein as if set forth in their entireties.

This application is also related to 1) U.S. Provisional Patent Application No. 61/019,278, filed Jan. 6, 2008, entitled "MicroDVI Connector;" 2) U.S. Provisional Patent Application No. 61/019,280, filed Jan. 6, 2008, entitled "USB Connector and Housing;" 3) U.S. Provisional Patent Application No. 61/010,116, filed Jan. 6, 2008, entitled "Mag Safe Connector;" 4) U.S. Nonprovisional patent application Ser. No. 12/242,784, filed Sep. 30, 2008, entitled "MicroDVI Connector;" 5) U.S. Nonprovisional patent application Ser. No. 12/242,712, filed Sep. 30, 2008, entitled "Data Port Connector and Housing;" and 6) U.S. Nonprovisional patent application Ser. No. 12/239,662, filed Sep. 26, 2008, now U.S. Pat. No. 7,762,817, entitled "System for Coupling Interfacing Parts."

TECHNICAL FIELD

Embodiments of the present invention relate generally to input/output connectors for computing devices, and more particularly to a pivotable input/output connector having a near-frictionless pivot and/or magnetic closure.

BACKGROUND

Computing devices ("computers") have become increasingly technically complex since their inception. Computers, even those capable of being carried in a single hand (such as a mobile phone or personal digital assistant), can perform many more functions at much greater speed than the computers of the 1950s and 1960s. Many of these expanded functions rely on interconnecting a computer with an accessory, another computer or other electronic device (collectively, "peripherals"). For example, peripherals may use a variety of standards to connect to a computer, including: universal serial bus (USB); FireWire; serial; parallel; and so forth. Different peripherals may employ different connectors or connection standards.

Traditionally, input/output ports occupy a fixed, stationary position in a computer. By maintaining a static position for the input/output ports ("I/O ports"), engineering of the computer case is simplified. However, fixed I/O ports may be inconveniently placed. Further, fixed I/O ports often are susceptible to dust and/or debris entering the ports and interfering with their functions.

Further, I/O ports are generally contained within a Faraday cage defined by the case of the computer. The Faraday cage generally prevents electrical noise from outside the cage entering the interior and vice versa. Thus, the computer case (be it the shell of a desktop or laptop computer, the casing of a mobile telephone or PDA, or other case/cage) prevents noise or extraneous signals from exiting the computer via the I/O ports and reaching a peripheral connected to the port(s). Similarly, the computer case may also prevent noise and/or extraneous signals generated by the peripheral, or another electronic device outside the case, from entering the case via the I/O port and internal associated connector cable. In short, the computer case electrically insulates its interior from its exterior.

Because the I/O ports are typically located within the barrier of a Faraday cage, they are stationary; moving ports might break the electrical barrier. I/O ports may be, for example, recessed within the case to place them within the cage. It may be inconvenient to access such recessed ports.

Accordingly, there is a need in the art for an improved I/O port.

SUMMARY

One embodiment of the present invention may take the form of a movable I/O port and associated housing. In particular, the I/O port housing may be hinged to pivot between an open and closed position. The pivot point may be a low-friction, or for practical purposes, a zero-friction, pivot. That is, the friction generated by opening or closing the I/O port housing to expose the port is sufficiently low as to have negligible effect on the motion of the port.

The I/O port housing may include an opening mechanism to facilitate pivoting the port between the open and closed positions, and/or vice versa. For example, the opening mechanism may take the form of paired magnets of like polarities. A first magnet may be located in a pivoting portion of the housing of the I/O port and a second magnet in a fixed segment of the housing, or alternatively in the computer case adjacent the housing. The first and second magnets may be slightly offset when the I/O port housing is in either or both of the open and closed positions. In this manner, the opposing magnetic force exerted when the first and second magnets are aligned (e.g., when the I/O port is in a partially open position) may bias the I/O port housing to continue moving in a direction of motion. For example, if the I/O port is moving from an open to a closed position, the magnet in the I/O housing and the case may briefly align, exerting a repelling force between the like-polarized magnets. Because the housing is fixed relative to the case in the direction of the repelling force and the housing is in motion, the force tends to continue the motion of the housing and thus bias the I/O ports to a closed or shut position. The magnets may operate in a like manner to bias the I/O housing (and thus I/O port) from a closed to an open position when the housing is moving toward the open position.

One embodiment may take the form of a housing for an interface of a computing device, including: a plate defining a mounting surface for mating to the computing device; a housing door proximate the plate and movable between an open and closed position; at least one interface accessible via the housing; and a hinge coupling the housing door to the plate. Further, the at least one interface is accessible from outside the computing device when the housing door is in an open position.

The embodiment may also include a first magnet placed within the housing door, the first magnet having a first polarity and a second magnet placed within the plate, the second magnet having a second polarity. The first and second polarities may be the same. Further, in such an embodiment the first and second magnets may be aligned along at least one axis during a motion of the housing door. Likewise, in the embodiment the first and second magnets may not align along the at least one axis when the housing door is open.

Another embodiment may take the form of a computing device shell, including: a chassis defining a notch and a housing for an interface with the computing device. In this embodiment, the housing may include: a plate defining a mounting surface for mating to the chassis; a housing door proximate the plate and movable between an open and closed position; at least one interface accessible via the housing; and a hinge coupling the housing door to the plate. Further, in the embodiment the at least one interface is accessible from outside the computing device when the housing door is in an open position.

Still another embodiment may be a method for forming an interface housing, including the operations of: providing a case; providing a housing door; placing a first magnet within the housing door; providing a plate; placing a second magnet within the plate; pivotally attaching the housing door to the plate; and affixing the plate to the case.

Those of ordinary skill in the art will appreciate additional embodiments and aspects upon reading this disclosure and the appended claims in their entireties.

DETAILED DESCRIPTION

One embodiment of the present invention may take the form of a movable I/O port and associated housing. In particular, the I/O port housing may be hinged to pivot between an open and closed position. The pivot point may be a low-friction, or for practical purposes, a zero-friction, pivot. That is, the friction generated by opening or closing the I/O port housing to expose the port is sufficiently low as to have negligible effect on the motion of the port.

The I/O port housing may include an opening mechanism to facilitate pivoting the port between the open and closed positions, and/or vice versa. For example, the opening mechanism may take the form of paired magnets of like polarities. A first magnet may be located in a pivoting portion of the housing of the I/O port and a second magnet in a fixed segment of the housing, or alternatively in the computer case adjacent the housing. The first and second magnets may be slightly offset when the I/O port housing is in either or both of the open and closed positions. In this manner, the opposing magnetic force exerted when the first and second magnets are aligned (e.g., when the I/O port is in a partially open position) may bias the I/O port housing to continue moving in a direction of motion. For example, if the I/O port is moving from an open to a closed position, the magnet in the I/O housing and the case may briefly align, exerting a repelling force between the like-polarized magnets. Because the housing is fixed relative to the case in the direction of the repelling force and the housing is in motion, the force tends to continue the motion of the housing and thus bias the I/O ports to a closed or shut position. The magnets may operate in a like manner to bias the I/O housing (and thus I/O port) from a closed to an open position when the housing is moving toward the open position.

Figure 1:
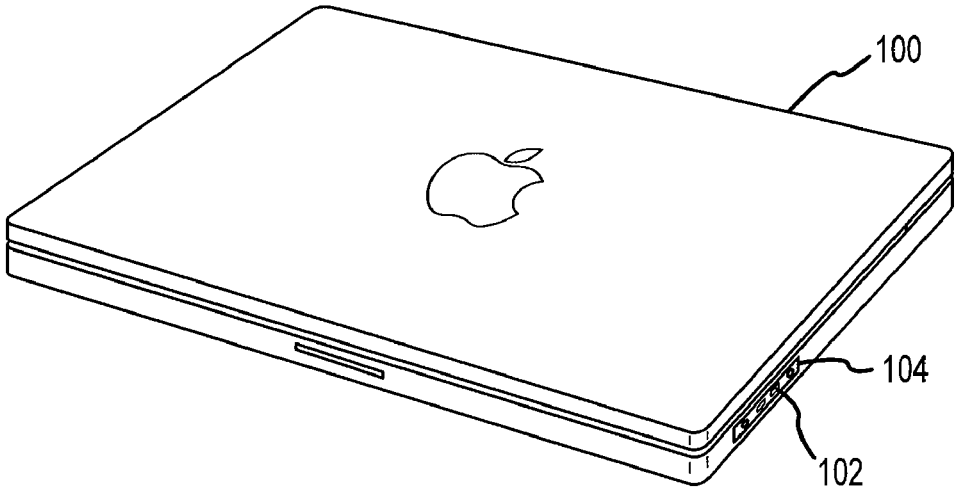
FIG. 1 depicts a first computing device.

FIG. 1 shows an exemplary computing device, in this case a notebook or laptop computer 100. The notebook computer 100 includes one or more I/O ports 102 which facilitate communication between the computer 100 (or its constituent elements) and a peripheral, as generally previously described. The I/O ports 102 are held within an I/O housing 104. As shown in FIG. 1, the I/O housing 104 of the computer 100 occupies a fixed position; therefore, the I/O ports 102 are likewise fixed. The ports are thus constantly accessible to a user or device outside the computer itself.

It should be noted that the computer 100 shown in FIG. 1 is depicted as a notebook computer purely for convenience. The computer could be any form of computing device having one or more I/O ports, such as a desktop computer, mainframe, miniframe, network server, handheld computing device, personal digital assistant, mobile telephone, music or audio player (such as an MP3 player), and so on. Accordingly, a "computer," as used generally herein, encompasses all such devices and any other computing device having an I/O port.

Figure 2:
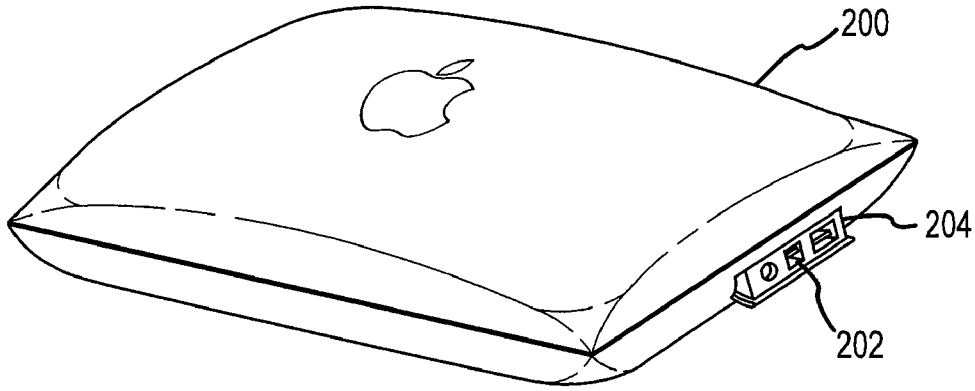
FIG. 2 depicts a first embodiment taking the form of a computing device having a closable I/O port housing.

FIG. 2 depicts a first embodiment of the present invention, specifically a notebook computer 200. As with the computer 100 of FIG. 1, the embodiment 200 includes one or more I/O ports 202 within an I/O housing 204. In this embodiment, however, the housing 204 may pivot between an open and closed position. In the open position, as shown in FIG. 2, the I/O ports 202 are exposed and can be accessed from outside the embodiment 200. When the housing is in a closed position, the I/O ports are covered and cannot be externally accessed. The housing and I/O ports generally sit within a notch formed in the chassis of the computer 200 when the housing is closed.

Figure 3:
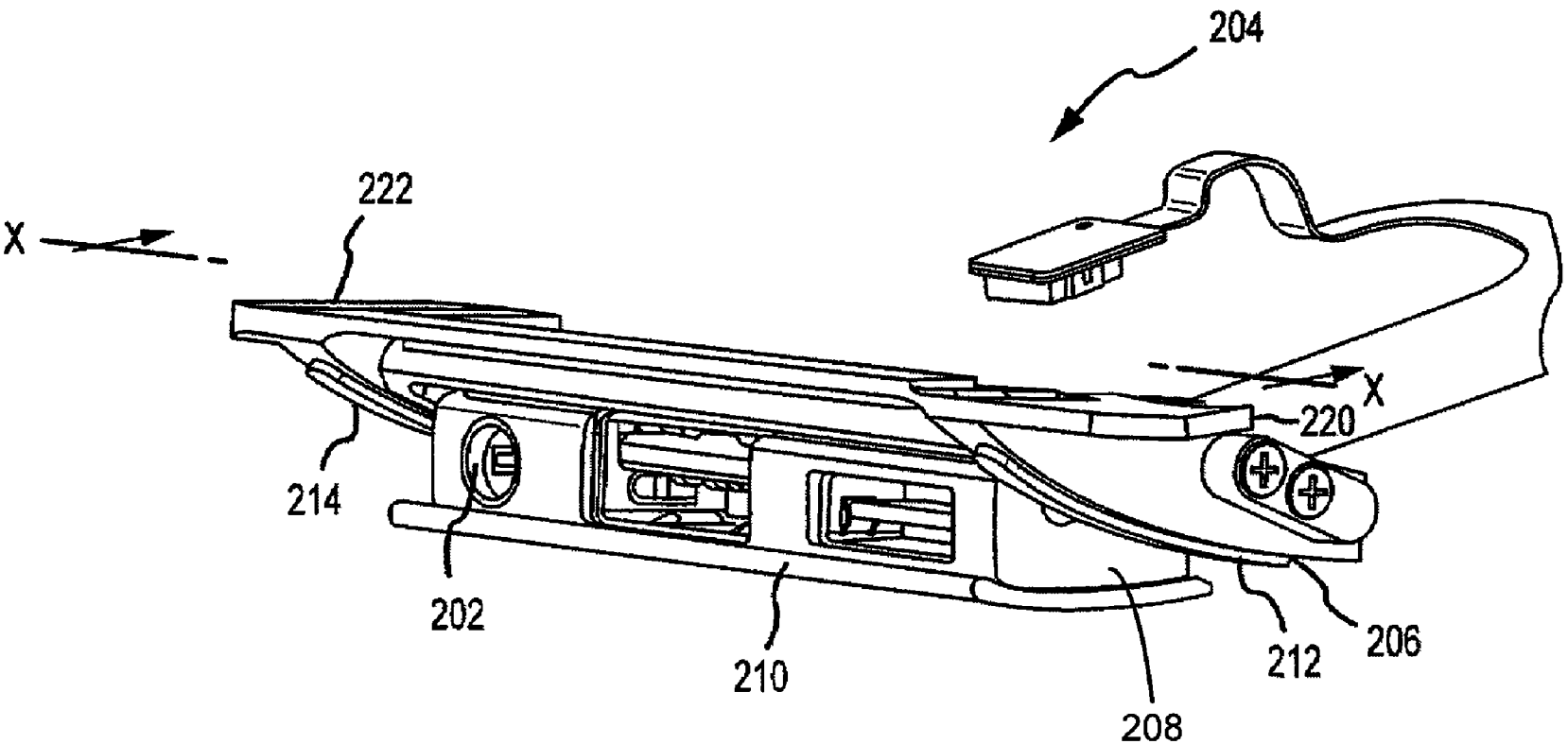
FIG. 3 depicts a front isometric view of the I/O ports and housing shown in FIG. 2.
Figure 4:
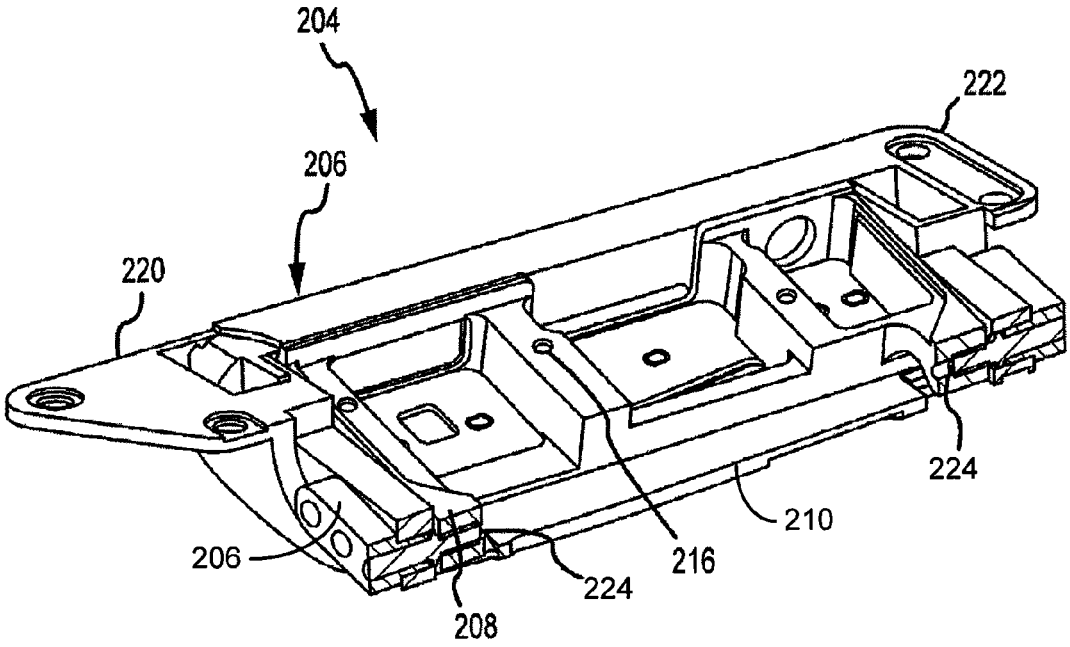
FIG. 4 depicts a rear isometric and partially cross-sectional view of the I/O ports and housing shown in FIG. 2.

Generally, the housing 204 of the present embodiment is formed from two separate and conjoined pieces, as shown to better effect in FIGS. 3 and 4. (It should be noted that alternative embodiments may employ a unitary housing made from a single piece.) A mounting plate 206 may affix to the case or chassis of the computer 200. A connector shell 208 may accept the I/O ports and may be affixed thereto. The connector shell 208 may joined to the mounting plate 206 by a hinge 224, best shown in FIG. 4. It should be noted that the view of FIG. 4 is cross-sectional through the pivot point of the housing 204 in order to show the hinge. It should also be noted that additional connections between the plate 206 and shell 208 may exist, as discussed in more detail below.

The mounting plate 206 includes two curved flanges 212, 214, best seen in FIG. 3. These flanges are curved or arcuate to follow the general exterior shape of the case of the embodiment 200. Similarly, a housing door 210 is likewise curved to match the exterior shape of the portion of the case in which the housing 204 sits. In this manner, when the housing 204 is closed (e.g., the housing door 210 is in the closed position shown in FIG. 4), the exterior surface of the plate 206 is contiguous with the case. This, in turn, presents a uniformly aesthetic appearance.

The I/O ports 202 may fit at least partially within the connector shell 208. The ports, which are typically attached to a flex cable, circuit board, coaxial cable or other data path, may be adhered, bonded, or mechanically affixed to the shell 208. Alternatively, the ports may be friction fitted in the shell 208, snap fitted therein, or otherwise removably placed within the shell.

In the present embodiment, the hatch door 210 may be considered part of the plate 206 and may be attached thereto mechanically. As shown in FIG. 4, the connector shell 208 sits behind the housing door 210. The shell 208 may include one or screw holes 216 so that the shell may be affixed to the plate 206. In alternative embodiments, adhesive, soldering, welding or other means may be used to affix the plate to the shell.

Typically, the mounting plate 206 is affixed to the chassis or case of the computer 200. The plate 206 includes one or more flanges 220, 222 that may rest on a portion of the computer chassis and be affixed thereto, for example with screws or other mechanical fasteners. One or more guide features (not shown) may be formed on the plate 206 and a mating segment of the chassis to facilitate connecting the two during assembly. For example, the chassis may include one or more guide pins that sit within a groove, notch or hole formed in or on the undersurface of the flanges 220, 222. When the plate is lowered onto the chassis the guide pins may seat within the grooves, thereby positioning the plate to be secured to the chassis during assembly. It should be noted that the grooves are typically slightly wider and/or longer than the corresponding dimensions of the guide pins. Accordingly, the plate 206 may move somewhat on the chassis before a mechanical fastener couples the two. However, the tolerancing differences between groove and pin are insufficient to cause the holes in the plate and chassis that accept the fastener to misalign.

The guide pins and grooves may be considered "alignment features." In some embodiments, the guide pins and grooves may be reversed such that the pins are formed on the plate and the grooves on the chassis. Further, alternative embodiments may employ different alignment features as known to those of ordinary skill in the art.

Figure 5:
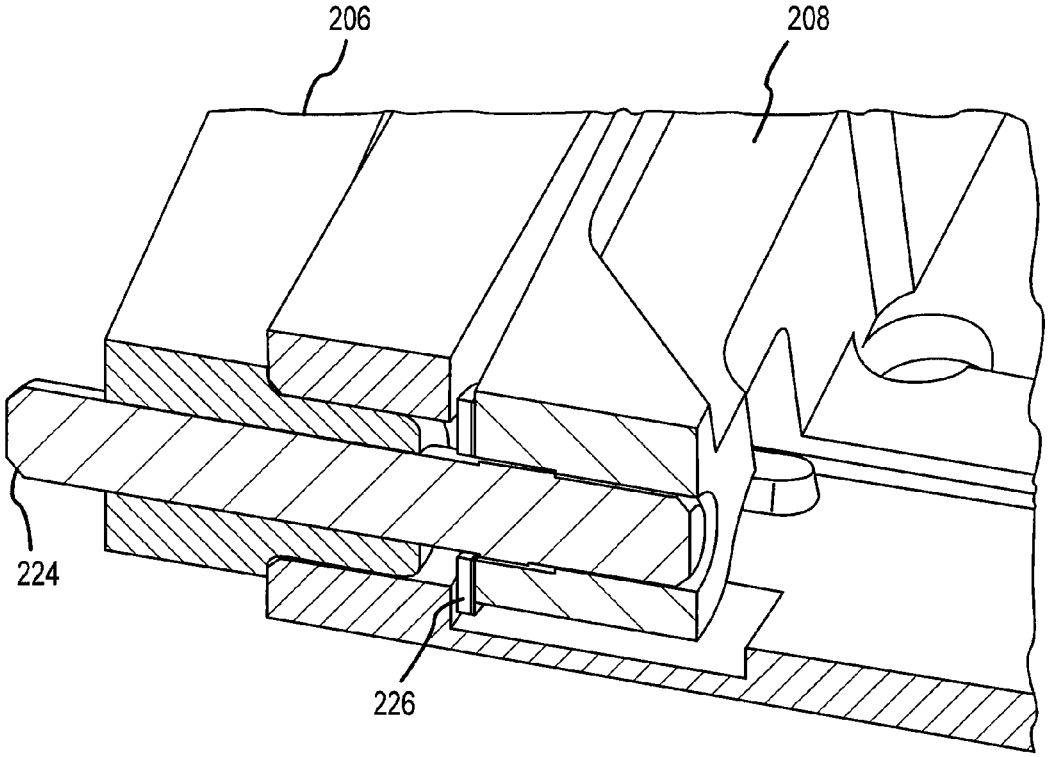
FIG. 5 depicts a cross-sectional view of an expanded portion of FIG. 4, specifically showing a hinge mechanism of the I/O housing of FIG. 2.

FIG. 5 is a detail view showing a hinge 224 connecting the mounting plate 206 to the connector shell 208. The hinge 224 may extend into or adjacent the chassis or case of the computer 200. The hinge may be, for example, a steel pin fitted into a delrin bushing. Generally, the hinge is press fitted into the connector shell 208 and slip fitted into the mounting plate 206. The hinge provides very low or no friction to resist the pivoting of the I/O housing 204 as it opens and closes to expose the I/O ports 202. Specifically, the shell 208 and a portion of the plate 206 may pivot to open or close while the outer portion of the plate 206, including the flanges 220, 222, remain stationary. One or more gap setters 226 may hold the hinge 224 in place laterally so that it does not "walk" within its setting. For example, the gap setter 226 prevents or reduces the likelihood of the hinge moving left or right in the view of FIG. 5. This also may facilitate fixing the lateral positions of the plate 206 and housing door 210/connector shell 208 with respect to one another.

Since the hinge 224 provides little or no friction to resist motion of the housing 204, the housing may be easily opened or closed with a touch. Indeed, given the lack of resistance to motion, the housing could relatively easily open or close inadvertently if no additional mechanism to control motion were provided. The present embodiment incorporates one or more pairs of magnets to assist in controlling opening and closing of the housing I/O housing 204.

Figure 6:
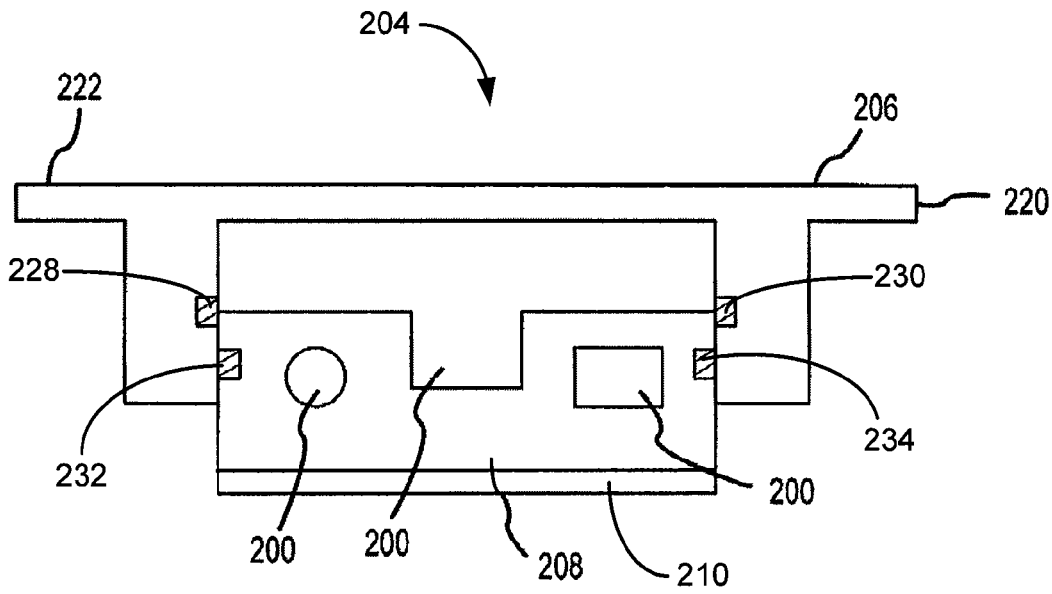
FIG. 6 depicts a simplified cross-sectional view of the I/O housing shown in FIGS. 3 and 4 with the housing in an open position, taken along line X-X of FIG. 3.
Figure 7:
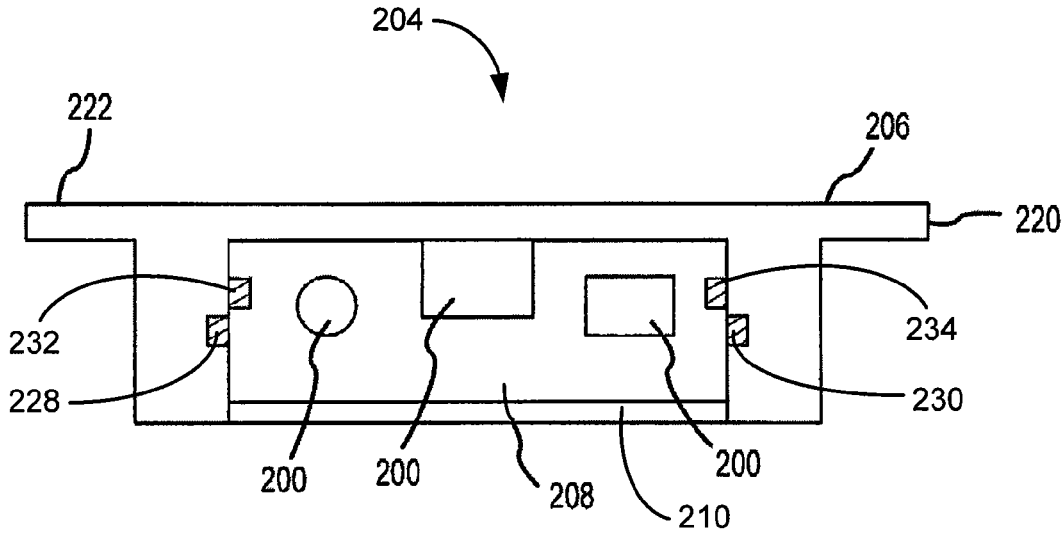
FIG. 7 depicts a simplified cross-sectional view of the I/O housing shown in FIGS. 3 and 4 with the housing in a closed position, taken along line X-X of FIG. 3.

FIG. 6 depicts the housing 204 in an open position while FIG. 7 depicts the housing in a closed position. In the open position of FIG. 6, the connector shell 208 and housing door 210 to which the shell is attached are lowered to provide access to the various I/O ports 200. (It should be recalled that the housing door 210 may be part of the mounting plate 206.) In the closed position shown in FIG. 7, the connector shell 208 and housing door 210 shield the I/O ports from exterior use.

First magnets 228, 230 are placed in a sidewall of the mounting plate 206. The first magnets 228, 230 are mounted in internal sidewalls of the plate 206 as shown in FIGS. 6 and 7. Typically, one side of each magnet 228, 230 is exposed. That is, the sidewalls of the plate 206 do not entirely surround the magnets. In the present embodiment, the magnets 228, 230 are of the same polarity but this need not be the case. Alternative embodiments may use two first magnets of differing polarities.

Second magnets 232,234 are placed within the sidewalls of the connector shell 208, as also shown in FIGS. 6 and 7. Like the first magnets 228, 230, one side of the second magnets 232, 234 is typically exposed and flush with the exterior of the connector shell 208 sidewalls. In alternative embodiments, the second magnets may not be flush with the sidewalls' exteriors or may not be externally exposed at all.

Generally, the facing side of each second magnet 232, 234 is of the same polarity as the facing side of its adjacent or same-side first magnet 228, 230. That is, the polarities of the facing sides of magnets 232 and 228 match, as do the polarities of the facing sides of magnets 230 and 234. (In other words, the poles of magnets 232 and 228 oppose each other, as do the poles of magnets 230 and 234) Accordingly, the magnets 228, 230 in the mounting plate 206 internal sidewalls exert an opposing force against the magnets 232, 234 in the external sidewalls of the connector shell 208 and vice versa.

As shown to best effect in FIG. 7, the first magnets 228, 230 are offset from the second magnets 232, 234 when the I/O housing 204 is closed. The magnets are offset vertically with respect to the housing itself and may, optionally, be offset laterally as well (e.g., inwardly and/or outwardly with respect to the view of FIG. 7). Similarly, when the housing 204 is open, the first magnets 228, 230 are again offset from the second magnets 232, 234. It should be understood that the amount of offset in either the open or closed positions may vary by embodiment.

Accordingly, as the housing 204 opens to expose the I/O ports 202 and the door 210 swings downward (e.g., moving from the position of FIG. 7 to the position of FIG. 6), the first magnets 228, 230 briefly align with the second magnets 232, 234 in the sidewalls of the connector shell 208. Since the first magnets are of like polarities from the second magnets, they repel one another with the effect of forcing the housing door 210 away from the inner sidewalls of the mounting plate 206. As mentioned above, the relative lateral positions of plate 206 and door 210/connector shell 208 are fixed. Accordingly, the door 210 and associated shell 208 and ports 202 cannot move laterally away from the magnets. It is also noted that the door 210 receives a repulsing force of approximately equal intensity from opposing sides, thus limiting any lateral motion even were it capable of such translation. Since the housing door 210 is already in downward motion, the repulsive face of the magnets may act to continue forcing the door downward into an open position. Similarly, when the door is transitioning from an open to a closed position, the magnet pairs 228, 232 and 230, 234 again come into alignment and generate a repulsive force. In this circumstance, the force may facilitate continuing the housing door's upward motion to a closed position.

In short, the magnets 232 and 228, and the magnets 234 and 230, are bi-stable and aligned to repel one another. When the magnet pairs 232, 228 and 234, 230 are axially aligned these repulsive forces are highest and the housing door 210 pivots in its direction of motion to minimize the force. Typically, the door pivots until it is entirely open or entirely closed as a result.

As a possible side benefit, the repulsive force generated by each magnet pair 228, 232 and 230, 234 tend to resist accidental shutting or opening of the housing door 210, for example by the action of gravity on an accidental motion of the computer 200. The magnets' strength, however, is insufficient in the present embodiment to prevent the housing door 210 from opening or closing with the touch of a single finger. In alternative embodiments, the magnets' strength may be varied. Further, alternative embodiments may employ a single pair of magnets rather than two pairs. However, the use of two matched magnet pairs as described herein may cause the shell 208 to be self-centering within the plate 206, insofar as roughly equal opposing forces are exerted on each side of the shell. Further, because roughly equal forces are exerted on both sides of the shell 208 during opening and closing, friction generated by the opening and closing mechanism may be reduced, especially when compared to an embodiment employing a single magnet pair.

It should be noted that the I/O housing 204 may be made from any suitable material such as aluminum, steel or another metal. As shown to best effect in FIG. 3, the housing door 210 is curved to match a curvature of the computer 200 case. Given the relative size of the I/O housing and the housing door segment in particular, the housing door 210 may be machined from a single piece of metal. The same is true for the connector shell 208. Machining may be more advantageous than sheet metal forming the door 210 given the door's size and the precise tolerancing necessary not only to match the curvature of the case, but for the door 210, shell 208 and plate 206 to fit together properly. Typically, the door, shell and plate are made of a metal but need not be made of the same metal. Further, in alternative embodiments one or all of these elements, as well as the hinge, may be made from a plastic or other suitable material.

The I/O housing 204 has generally been described as being formed from four separate, attached pieces, specifically the mounting plate 206, housing door 210, connector shell 208 and hinge 224. Alternative embodiments may omit any or all of these elements or may combine two or more into a single piece. For example, the housing door 210 and connector shell 208 may be formed as a unitary piece in certain embodiments. Similarly, any and all of these pieces may be made from any suitable material. Further, it should be appreciated by those of ordinary skill in the art that many variants and changes to the apparatuses and processes discusses herein may be made without departing from the spirit and scope of the invention. For example, embodiments have been generally described in the context of providing a housing for one or more I/O ports. It should be understood that embodiments may provide housings for power inputs, storage, lights or light-emitting diodes, buttons or controls, and so forth. Accordingly, all examples given herein are intended to be illustrative rather than limiting.

We claim:

1. A housing for an interface of a computing device, comprising:

a plate defining a mounting surface for mating to the computing device;

a housing door proximate the plate and movable between an open and closed position;

at least one interface accessible via the housing;

a hinge coupling the housing door to the plate, wherein the at least one interface is accessible from outside the computing device when the housing door is in an open position;

a first magnet proximate the housing door, the first magnet having a first polarity; and a second magnet placed within the plate, the second magnet having a second polarity, wherein the facing ends of the first and second magnets are of a like polarity.

2. The apparatus of claim 1, wherein the at least one interface is inaccessible from outside the computing device when the housing door is in a closed position.

3. The apparatus of claim 1, further comprising:

a first sidewall extending from the plate and having a first outer edge;

a second sidewall extending from the plate and having a second outer edge; wherein the first and second outer edges are flush with an exterior of the housing door when the housing door is in the closed position.

4. The apparatus of claim 1, wherein:

the first and second magnets are aligned along at least one axis during a motion of the housing door; and the first and second magnets are not aligned along the at least one axis when the housing door is open.

5. The apparatus of claim 4, wherein the first and second magnets are not aligned along the at least one axis when the housing door is closed.

6. The apparatus of claim 5, further comprising a low-friction hinge connecting the housing door to the plate.

7. The apparatus of claim 6, further comprising a gap setter affixed to the hinge, the gap setter maintaining an axial position of the hinge.

8. The apparatus of claim 7, wherein the gap setter further maintains a set distance between the housing door and the plate along at least one axis.

9. The apparatus of claim 1, wherein the interface is an input/output port.

10. A computing device shell, comprising:

a chassis defining a notch;

a housing for an interface with the computing device, the housing comprising:

a plate defining a mounting surface for mating to the chassis;

a housing door proximate the plate and movable between an open and closed position;

at least one interface accessible via the housing a hinge coupling the housing door to the plate; and a first magnet and a second magnet oriented such that the facing ends of the first and second magnets are of a like polarity to bias the housing door in either the open or closed position;

wherein the at least one interface is accessible from outside the computing device when the housing door is in an open position.

11. The apparatus of claim 10, wherein the interface is an input/output port.

12. The apparatus of claim 10, wherein the plate is integral to the chassis.

13. The apparatus of claim 10, wherein the at least one first magnet and at least one second magnet exert an opposing force against one another when aligned; and the opposing force moves the housing door such that the at least one first magnet and at least one second magnet become misaligned.

14. A method for forming an interface housing, comprising:

providing a case;

providing a housing door;

placing a first magnet within the housing door;

providing a plate;

placing a second magnet within the plate, wherein the first magnet and the second magnet are of a like polarity;

pivotally attaching the housing door to the plate; and affixing the plate to the case.

15. The method of claim 14, wherein the operation of pivotally attaching the housing door to the plate comprises:

affixing the housing door to the plate with a hinge;

placing a gap setter on the hinge; and aligning the housing door and the plate such that the first magnet and second magnet align along at least one axis during an opening motion of the housing door.

16. The method of claim 14, wherein the operation of affixing the plate to the case comprises:

matching a first alignment feature formed on the plate with a second alignment feature formed on the case; and once the first alignment feature is matched to the second alignment feature, attaching the plate to the case.

17. The method of claim 16, wherein:

the first alignment feature is a groove; and the second alignment feature is a guide pin.

18. The method of claim 14, wherein the housing door comprises an aperture through which an interface may be accessed.

* * * * *

UNITED STATES PATENT AND TRADEMARK OFFICE

CERTIFICATE OF CORRECTION

PATENT NO. : 7,845,953 B2
APPLICATION NO. : 12/201867
DATED : December 7, 2010
INVENTOR(S) : John Brock et al.

It is certified that error appears in the above-identified patent and that said Letters Patent is hereby corrected as shown below:

In column 6, line 63, delete “face” and insert -- force --, therefor.

Signed and Sealed this
Twenty-fifth Day of October, 2011

David J. Kappos

David J. Kappos
*Director of the United States Patent and Trademark Office*